United States Patent [19]

Enright

[11] 4,253,285

[45] Mar. 3, 1981

[54] PERCOLATING WATER DRAINAGE SYSTEM

[76] Inventor: Michael F. Enright, 153 N. River Rd., Munroe Falls, Ohio 44262

[21] Appl. No.: 968,465

[22] Filed: Dec. 11, 1978

[51] Int. Cl.[3] ..... E04B 1/64

[52] U.S. Cl. ..... 52/169.5; 52/303

[58] Field of Search ..... 52/169.5, 302, 303, 52/197, 264

[56] References Cited

U.S. PATENT DOCUMENTS

| | | | |
|---|---|---|---|
| 1,430,423 | 9/1922 | Weichold | 52/303 |
| 2,703,002 | 3/1955 | Suskind | 52/302 |
| 3,283,460 | 11/1966 | Patrick | 52/169.5 |
| 3,304,672 | 2/1967 | Bakke | 52/169.5 |
| 3,562,982 | 2/1971 | Parezo | 52/169.5 |
| 3,613,323 | 10/1971 | Hreha | 52/169.5 |
| 3,656,268 | 4/1972 | Murati | 52/169.5 |
| 3,668,829 | 6/1972 | Nelson | 52/169.5 |

FOREIGN PATENT DOCUMENTS

| | | | |
|---|---|---|---|
| 391241 | 8/1965 | Switzerland | 52/302 |

*Primary Examiner*—James L. Ridgill, Jr.

*Attorney, Agent, or Firm*—Oldham, Oldham, Hudak & Weber Co.

[57] ABSTRACT

A drainage device for building foundations is provided, composed of a tubular structure having apertures in its upper and side surfaces and a drainage orifice at one end thereof. The device is sized to permit installation between segments of the building material forming the foundation and may be surrounded by mortar. Water percolating through the foundation is collected via the apertures and drained away from the foundation through the tubular structure. Any number of such drainage devices may be installed during construction of the building foundation.

1 Claim, 2 Drawing Figures

PERCOLATING WATER DRAINAGE SYSTEM

BACKGROUND OF THE INVENTION

This invention relates to a percolating water drainage system which may be installed in building foundations to provide for the collection and removal of water seeping through the foundation.

Heretofore, numerous methods in the art of drainage have been applied to subterranean foundations which are susceptible to fluid seepage, typically water. Porous building materials, such as concrete block commonly used in all phases and types of construction are susceptible to percolation of water and seepage through the material and into the interior portion of the structure. This percolation of water seeks the porous building material as a means of drainage, in comparison with packed earth or other compressed compositions existing adjacent to the building foundation. The natural currents of the percolation of the water through the porous building materials cannot be prevented without major expense after the excavation, construction and grading of the building area has occurred. During the construction of the foundation, numerous efforts have been undertaken to prevent this percolating water from entering the interior of the structure.

For example, U.S. Pat. No. 3,656,268 provides an elaborate mechanism for the interior drainage of a basement wall structure utilizing a drainage conduit. U.S. Pat. No. 3,283,460 utilizes the placement of a special angled member engaging the footer of the structure, the wall of the structure and the subterranean flooring of the structure. Special channels within this angled member provide drainage from the interior of the wall to the area beneath the subterranean floor. U.S. Pat. No. 3,304,672 provides a baseboard around the periphery of the inside wall of the foundation providing drainage onto the interior subterranean floor into which further drainage equipment has been set. These three patents provide drainage structures which take the percolating water from the existing foundation wall and place it onto the subterranean floor. Promotion of a pathway from the exterior of the foundation wall to the interior encourages percolating water to transfer into the interior of the structure. Transfer of the water by this means creates a deleterious effect on the overall support of the building foundation through time.

Another method for drainage of the percolating water is described in U.S. Pat. No. 3,668,829, wherein an additional structure is provided at an angle within the footer of the building structure which connects the drain tile outside of the building wall and a porous granular passageway from that point to the drain tile located beneath the subterranean floor. Once again, these two patents teach a method of drainage of percolating water which encourages flow from the exterior of the building structure to the interior of the building structure either through the building blocks or immediately beneath them. Any defects in such a drainage system would leave the subterranean floor susceptible to percolating water flow without adequate drainage therefrom.

Elaborate systems to provide drain tile to concrete foundations have been disclosed in U.S. Pat. No. 3,613,323, wherein the structure of the drain is interposed within the wall casting. Such a structure is not adaptable to the typical porous building materials known to those skilled in the art, because there is no transfer of flow from the structure to the drain tile.

Other drainage methods are typified by U.S. Pat. No. 3,562,982, wherein an elaborate system of base building blocks has been modified to permit drainage freely between the building structure and other subterranean drainage structures. A special modification of such building block is costly to the building art and the use of slots in the lower surface of the lowest building block renders it susceptible to obstructions which could not be removed without reexcavation. U.S. Pat. No. 3,426,487 teaches the interconnection of the sump pump with concrete channels connected to an interior conduit system which is then pumped to a drain spout located on the eave of the building structure. Such an elaborate system is extremely costly and difficult to maintain, with any prospect of breakdown again drawing water into the interior of the building structure.

Consequently, no device in the art provides an inexpensive and simplified system for draining water from building foundations to the exterior of the building structure. The art teaches either an elaborate system of modifications to the existing building blocks, or added equipment which brings water into the interior of the structure for complete drainage.

OBJECTS OF THE INVENTION

In light of the foregoing, it is an object of the present invention to provide the improvement of a drainage system for building foundations, whereby percolating water is transferred from the building structure to a point on the exterior of the building structure.

It is another object of the present invention to provide the improvement of a drainage system for building foundations, whereby the devices used in such collection and drainage of percolating water comprise a simplified structure requiring minimal cost and tooling.

Yet another object of the invention is to provide the improvement of a drainage system for building foundations, in which drainage devices may be maintained in the space reserved for mortar between various segments of the foundation.

Still another object of the invention is to provide the improvement of a drainage system for building foundations, in which drainage devices have a plurality of collection areas to receive water percolating down the porous building foundation.

It is yet another object of the invention to provide the improvement of a drainage system for building foundations, in which drainage devices include a structure for properly draining, without obstruction, the percolating water collected.

Still another object of the present invention is to provide the improvement of a drainage system for building foundations, in which drainage devices may be used in any number sufficient to properly drain the building foundation.

Moreover, it is another object of the invention to provide the improvement of a drainage system for any structure, whereby a plurality of drainage devices exist on the structure, collecting the flow of a liquid and transferring it to another area of the structure for drainage.

SUMMARY OF THE INVENTION

The foregoing and other objects of the invention which will become apparent as the detailed description of the preferred embodiments proceed are achieved by:

the improvement of a drainage system for building foundations, comprising: a plurality of hollow members, each said hollow member having a drainage portion and a percolation collection portion, and each said hollow member engaging the building foundation. Further, the objects of the invention are achieved generally by: a drainage device, comprising: a hollow member having an aperture means for receiving percolating fluid and drainage means for dispensing the percolated fluid.

DESCRIPTION OF THE DRAWINGS

For a complete understanding of the structure of the present invention, reference is had to the following drawings.

DETAILED DESCRIPTION OF THE PREFERRED EMBODIMENTS

Figure 1:
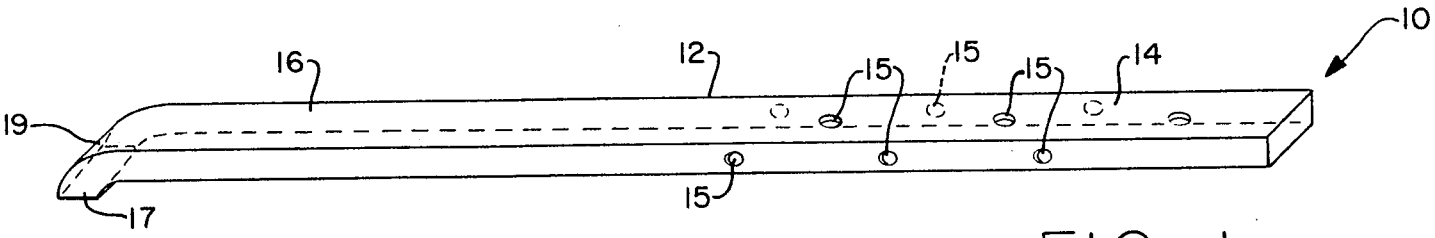
FIG. 1 is a perspective view of the percolating water drainage device.

For a complete understanding of the design and structure of the percolating water drainage system, generally designated as 10, reference is had to FIG. 1. The system 10 is composed of a multiplicity of hollow drainage members 12, each having two portions: a percolation collection portion 14 and a drainage portion 16. A plurality of hollow drainage members 12, comprising system 10, may be joined or placed together, to have or assimilate a common side surface. As such, the drainage members 12 may form a contiguous series of percolation collection portions 14 for transport of percolating fluids to the exterior of the foundation system 20.

The hollow drainage member 12 may be of any shape conductive to the transmission of fluid, but typically the shape is a rectangular tubular design capable of being interposed into the foundation system 20. Generally, the size of the hollow drainage member 12 may be determined by the requirements for the particular building system. Preferably, the hollow drainage member 12 is substantially ¾" in width and ⅜" in depth, meeting the requirements for the thickness of mortar joints commonly used by those skilled in the art for construction of foundations. Again, the length of the hollow drainage member 12 is determined by the width of the foundation system used. Preferably, the length of hollow drainage member 12 is substantially between 12" and 16", depending on the width of the porous building material 22.

The hollow drainage member 12 may be molded or extruded from materials commonly known in the art for lightweight but sturdy structures. Typically, the materials used may be a polymeric material or a lightweight metallic composition which is resistant to corrosion and deterioration caused by oxidation or other chemical destructive forces. The hollow drainage member 12 may be enclosed at the end closest to the percolation collection portion 14 to insure proper flow within member 12 without departing from the scope of the invention.

Percolation collection portion 14 is that portion of hollow drainage member 12 wherein resides the multiplicity of percolation apertures 15. These apertures 15 are contained on the upper and side surfaces of the percolation collection portion 14 into which the percolating fluid flows. The number, size, and placement on the upper and side surfaces of the percolation collection portion 14 for percolation apertures 15 may be altered without departing from the scope of the invention. Typically, the number of the percolation apertures 15 may be increased to provide greater collection of the percolating fluids within the building structure 20.

Drainage portion 16 is that portion of hollow drainage member 12 which transfers the percolating fluids to the terminus 19 of hollow drainage member 12. At the terminus 19 of hollow drainage member 12 is a drainage nozzle 17 which dispenses with the percolating fluids from the entire system. The drainage nozzle 17 is shaped to transmit percolating fluids downward from the structure, and this shape prevents the obstruction of the drainage portion 16 by foreign matter or material in the drainage area as when the foundation is back-filled.

Figure 2:
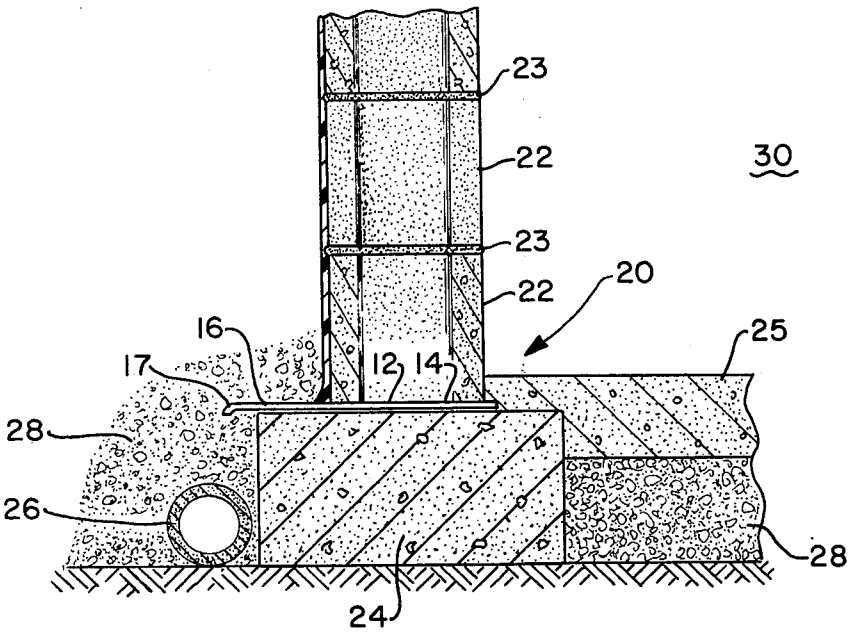
FIG. 2 is a side plan cross-sectional view of a foundation system with the percolating water drainage device installed.

Referring now to FIG. 2, a cross-sectional side plan view of a foundation system, generally designated as 20, the installation and function of percolating water drainage system 10 can be seen and understood. The existing foundation system 20 has been shown as a foundation typically known to those skilled in the art. The foundation system 20 is composed of a porous building material 22 in segmented layers, mortar 23 separating building material 22, a support slab 24 supporting the wall of materials 22 and mortar 23, and interior slab flooring 25 substantially connected to a support slab 24 and porous building material 22 and mortar 23. Surrounding the support structure of the foundation system 20 is a drainage system composed of gravel 28, located on the exterior of the foundation system 20, and beneath the interior slab flooring 25. Residing within the gravel 28 on the exterior of the foundation system 20 is drainage tile 26.

Without the use of percolating water drainage system 10, the fluids seep through the porous building material 22, commonly composed of concrete block, and into the interior portion of the building, generally designated as 30. Because no adequate drainage device typically exists for removal of those percolating fluids from the interior of the building 30, the seepage remains on the interior slab flooring 25. The constant transmission of percolating fluids through the porous building material 22 weakens the overall structure of the entire foundation system 20 and, of course, limits the utility of the building 30 due to dampness, mildew, and the like. Inadequate drainage of the foundation system 20 may cause shifting in the overall subterranean support of the foundation system 20 causing serious structural weaknesses in the entire foundation system 20. The existence of drainage tile 26 and gravel 28 provides on the exterior of the foundation system 20 adequate removal of seepage of fluids existing in the earth surrounding the foundation system 20.

The installation and placement of percolating water drainage system 10 on the exterior of the foundation system 20 adequately removes the percolating fluids from the porous building material 22 and mortar 23 and transfers them to the gravel 28 for transmission to drainage tile 27. By accepting and receiving percolating fluids from the porous building material 22 and mortar 23, the percolating water drainage system 10 adequately drains the foundation system in a direction away from the interior of the building 30. The percolation apertures 15 on percolation collection portion 14 of hollow drainage member 12 perform the acceptance and reception of the percolating fluids for transmission to the drainage portion 16 having a drainage nozzle 17. The gravel 28 about drainage portion 16 does not obstruct the flow of the percolating fluids by the employment of drainage nozzle 17 which extends downwardly from the hollow drainage member 12.

The percolating water drainage system 10 may have hollow drainage member 12 existing at any point along the foundation system 20. The members 12 may be spaced at regulated intervals according to a construction plan, or the members 12 may be interspaced at irregular points as necessitated by particular drainage deficiencies. The installation of members 12 into foundation system 20 is accomplished during the initial construction of the porous building material 22 and mortar 23. The members 12 may reside in the spaces designated for the mortar 23 between porous building material 22 at any point along the length of the foundation system. Preferably, the hollow drainage members 12 reside at the interconnection of the porous building material 22 and mortar 23 with support slab 24. This maximizes drainage of the percolating fluids from the foundation system 20 and permits gravel 28 to transmit those fluids into drainage tile 26. As described hereinabove, the length of hollow drainage members 12 may be reduced to permit its insertion into an upper portion of mortar 23 between porous building materials 22. With such a structure, the length of hollow drainage member 12 needed to extend beyond support slab 24 is no longer needed. Drainage nozzle 17 then would dispense the percolating fluids along the exterior wall and into the surrounding materials.

While only a single embodiment of a percolating water drainage system 10 has been disclosed, it is to be understood that modification of any one portion or member of that system to achieve similar structural significance in adaptation to various foundation systems does not depart from the scope of the invention in any manner whatsoever. Indeed, the true scope and breadth of the invention is set forth in the following claims.

What is claimed is:

1. In a building foundation of blocks interconnected by mortar joints having a particular thickness, the improvement of a drainage system to the exterior of the building foundation, comprising:

a plurality of hollow members being substantially of said particular thickness and being received by certain of the mortar joints, each said hollow member having a drainage portion and a percolation collection portion, and each said hollow member engaging the building foundation, said percolation collection portion of each said hollow member having a plurality of apertures for receiving water from the foundation and being maintained within the associated mortar joint, said drainage portion of each said hollow member extending from the exterior of the building foundation, whereby said hollow members remove fluid from the building foundation and transfer it outside of the building.

* * * * *